US011217925B2

(12) United States Patent
Tsuchiya

(10) Patent No.: US 11,217,925 B2
(45) Date of Patent: Jan. 4, 2022

(54) FEMALE TERMINAL

(71) Applicant: Sumitomo Wiring Systems, Ltd., Mie (JP)

(72) Inventor: Takahiro Tsuchiya, Mie (JP)

(73) Assignee: Sumitomo Wiring Systems, Ltd.

( * ) Notice: Subject to any disclaimer, the term of this patent is extended or adjusted under 35 U.S.C. 154(b) by 92 days.

(21) Appl. No.: 16/711,618

(22) Filed: Dec. 12, 2019

(65) Prior Publication Data

US 2020/0203869 A1 Jun. 25, 2020

(30) Foreign Application Priority Data

Dec. 21, 2018 (JP) ..... JP2018-239273

(51) Int. Cl.
*H01R 13/11* (2006.01)
*H01R 4/18* (2006.01)

(52) U.S. Cl.
CPC ..... *H01R 13/11* (2013.01); *H01R 4/185* (2013.01); *H01R 13/113* (2013.01)

(58) Field of Classification Search
CPC ..... H01R 13/113; H01R 4/185; H01R 13/11; H01R 13/114
USPC ..... 439/852
See application file for complete search history.

(56) References Cited

U.S. PATENT DOCUMENTS 5,443,592 A * 8/1995 Ittah ..... H01R 13/113 439/839
5,791,945 A * 8/1998 Myer ..... H01R 13/113 439/852
6,293,833 B1 * 9/2001 Kamath ..... H01R 13/113 439/839
8,998,656 B2 * 4/2015 Amano ..... H01R 13/187 439/852
10,403,998 B2 * 9/2019 Hayashi ..... H01R 13/113

FOREIGN PATENT DOCUMENTS

JP 2004-039559 2/2004

* cited by examiner

*Primary Examiner* — Renee S Luebke
*Assistant Examiner* — Paul D Baillargeon
(74) *Attorney, Agent, or Firm* — Gerald E. Hespos; Michael J. Porco; Matthew T. Hespos

(57) ABSTRACT

A female terminal (10) includes a rectangular tubular body (24) extending in a front-rear direction. A first resilient piece (26A) is folded from a bottom wall (16) into the body (24) via a first base end (40), and a second resilient piece (26B) is folded from the bottom wall (16) into the body (24) via a second base end (42) in the same folding direction as the first resilient piece (26A). The second base end (42) is displaced from the first base end (40) in the front-rear direction. The second resilient piece (26B) is closer to the bottom wall (16) than the first resilient piece (26A). The second resilient piece (26B) is pressed by the first resilient piece (26A) and resiliently displaced toward the bottom wall (16) with the second base end (42) as a fulcrum when the first resilient piece (26A) is displaced toward the bottom wall (16).

3 Claims, 8 Drawing Sheets

FEMALE TERMINAL

BACKGROUND

Field of the Invention

This specification relates to a female terminal.

Related Art

Japanese Unexamined Patent Publication No. 2004-39559 discloses a female terminal with a rectangular tube into which a tab of a male terminal fitting is inserted. A resilient contact piece is provided inside the rectangular tube and is configured to contact the tab. The resilient contact piece is folded into the rectangular tube from a resilient contact piece base end part connected to a front end of a bottom wall of the rectangular tube. This resilient contact piece is formed into a chevron shape when viewed laterally and has a top part near a central part of the resilient contact piece. This top part is struck upward to form a contact portion.

The top part of the resilient contact piece contacts the tab of the male terminal fitting when the tab is inserted into the rectangular tube, and a certain contact pressure is applied to the tab while the resilient contact piece is displaced resiliently toward the bottom wall with the resilient contact piece base end part as a fulcrum. However, under a high-temperature environment, the resilient contact piece and the resilient contact piece base end part undergo creep deformation so that the contact pressure applied to the tab is reduced.

SUMMARY

A female terminal disclosed in this specification includes a rectangular tubular body extending in a front-rear direction. The body has peripheral walls. A first resilient piece is folded and cantilevered from the peripheral wall into the body via a first base end part, and a second resilient piece is folded and cantilevered from the peripheral wall connected to the first base end part into the body via a second base end part in the same direction as a folding direction of the first resilient piece. The second base end part is spaced from the first base end part in the front-rear direction. Additionally, the second resilient piece is closer to the peripheral wall than the first resilient piece. Thus, the second resilient piece is pressed by the first resilient piece and resiliently displaced toward the peripheral wall with the second base end part as a fulcrum when the first resilient piece is displaced resiliently toward the peripheral wall.

The first resilient piece that is displaced resiliently toward the peripheral wall presses the second resilient piece and displaces the second resilient piece toward the bottom wall. Thus, a contact pressure is applied to a male terminal inserted into the body by reaction forces of the first and second resilient pieces. At this time, the first and second resilient pieces are displaced resiliently so that a stress is distributed to the first and second base end parts. Therefore, a maximum stress applied to the base end part of one resilient piece is reduced as compared to a configuration in which only a first resilient piece is provided. Therefore, a reduction of the contact pressure applied to the male terminal due to creep deformation under a high-temperature environment can be suppressed.

The second base end part may be folded into an arc with the peripheral wall side as a start end. The first resilient piece may be composed of an extending portion and a contacting portion. The extending portion extends farther away from the peripheral wall as the extending portion extends rearward from the first base end part. The contacting portion extends to approach the peripheral wall as the contacting portion extends rearward from a rear end of the extending portion. Additionally, the contacting portion resiliently displaces the second resilient piece toward the peripheral wall. A rear end position of the extending portion and a start end position of the second base end part may be at the same position or substantially the same position in the front-rear direction.

By setting the rear end position of the extending portion and the start end position of the second base end part substantially at the same position in the front-rear direction, the contacting portion of the first resilient piece contacts the second resilient piece. Thus, the stress is distributed more easily from the contacting portion to the second base end part.

The first base end part and the second base end part may have the same size and the same shape or substantially the same size and shape. Thus, stress applied to the first and second base end parts is not shifted toward either one side.

The peripheral wall that has the first resilient piece may be a bottom wall, and a side wall may be adjacent to the bottom wall. An auxiliary resilient piece that is resiliently displaceable toward the bottom wall may be provided on the side wall. The auxiliary resilient piece may be located closer to the bottom wall than the second resilient piece. The second resilient piece may be pressed by the first resilient piece to resiliently displace the auxiliary resilient piece toward the bottom wall when the first resilient piece is resiliently displaced toward the bottom wall. Thus, the stress is distributed to the first base end part of the first resilient piece, the second base end part of the second resilient piece and the auxiliary resilient piece, and a reduction of the contact pressure applied to the male terminal due to creep deformation under a high-temperature environment is suppressed further.

Accordingly, the female terminal disclosed in this specification suppresses a reduction of the contact pressure applied to the male terminal due to creep deformation under a high-temperature environment.

DETAILED DESCRIPTION

Figure 1:
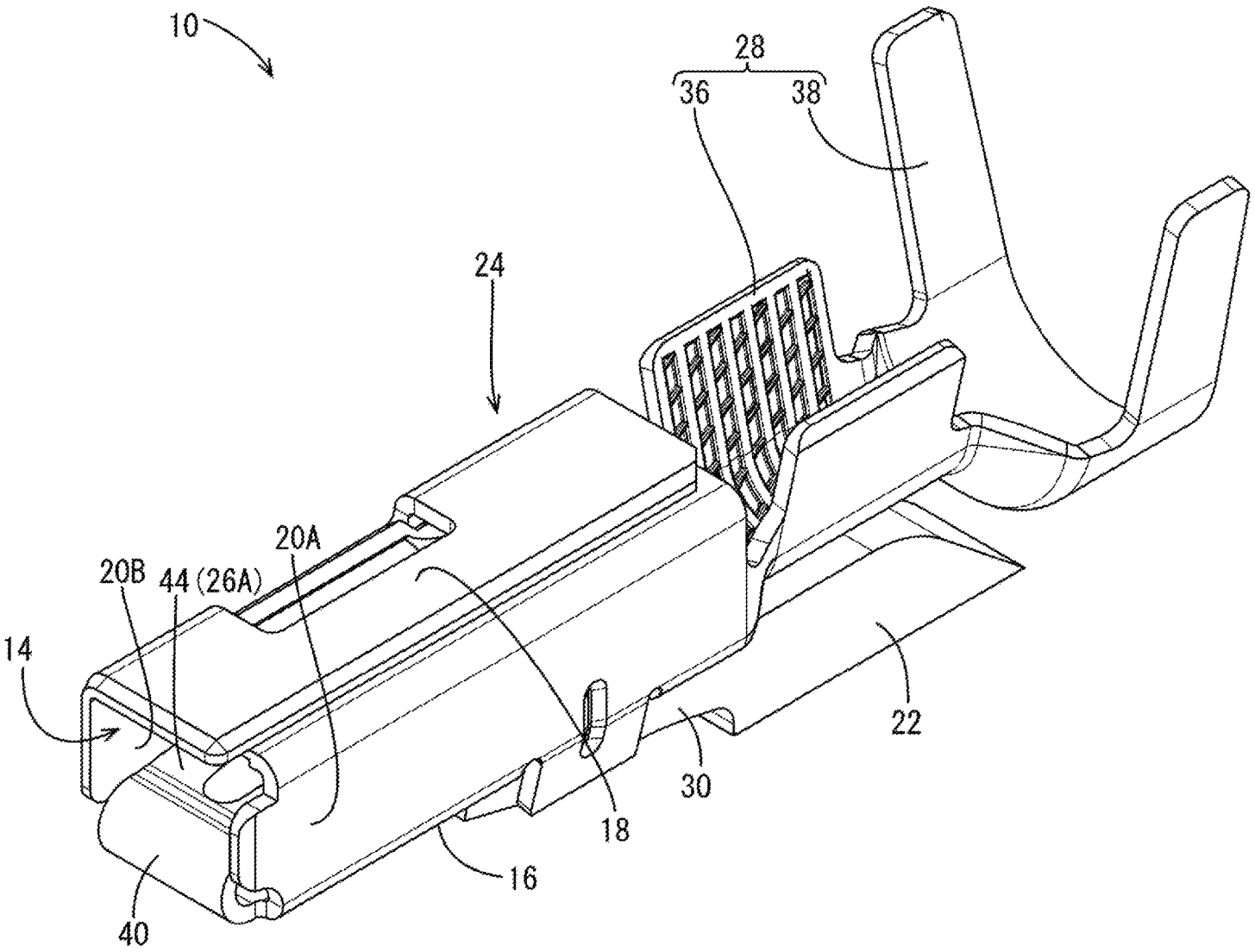
FIG. 1 is a front perspective view of a female terminal in a first embodiment.

A female terminal 10 of a first embodiment is described with reference to FIGS. 1 to 4. In the following description, a connecting direction (lateral direction in FIG. 4) of the female terminal 10 is referred to as a front-rear direction, and an opening 14 (left side in FIG. 4) into which a plate-like male terminal 12 is inserted is referred to as a front. Further, a direction from a bottom wall 16 toward a ceiling wall 18 in FIG. 4 is referred to a vertical upward direction, and a direction from a side wall 20A toward a side wall 20B in FIG. 3 is referred to a lateral rightward direction.

Figure 4:
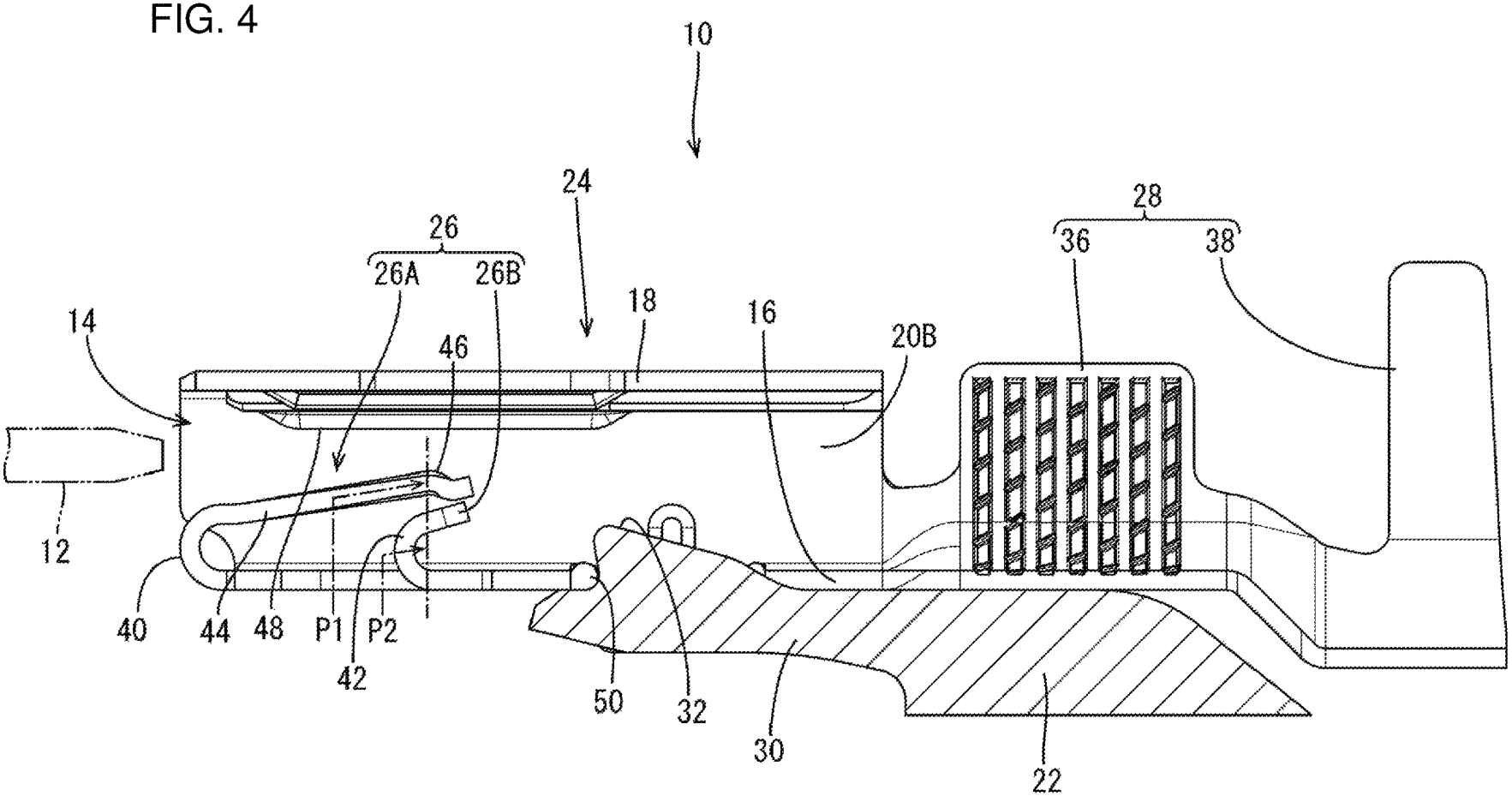
FIG. 4 is a section along A-A in FIG. 3.

The female terminal 10 is to be accommodated into a female housing 22 and includes, as shown in FIG. 4, a rectangular tubular body 24 extending in the front-rear direction. The male terminal 12 is inserted into the body 24 through the opening 14 in the front. The female terminal 10 also has a resilient piece 26 for applying a contact pressure to the male terminal 12, and a wire connecting portion 28 to be connected to a core of an unillustrated wire.

As shown in FIG. 4, a forwardly cantilevered locking lance 30 is provided in the female housing 22, and a lock 32 projects on the upper surface of the locking lance 30. Although the locking lance 30 is provided in a cavity of the female housing 22, only the locking lance 30 is shown as a component of the female housing 22 for convenience.

Figure 2:
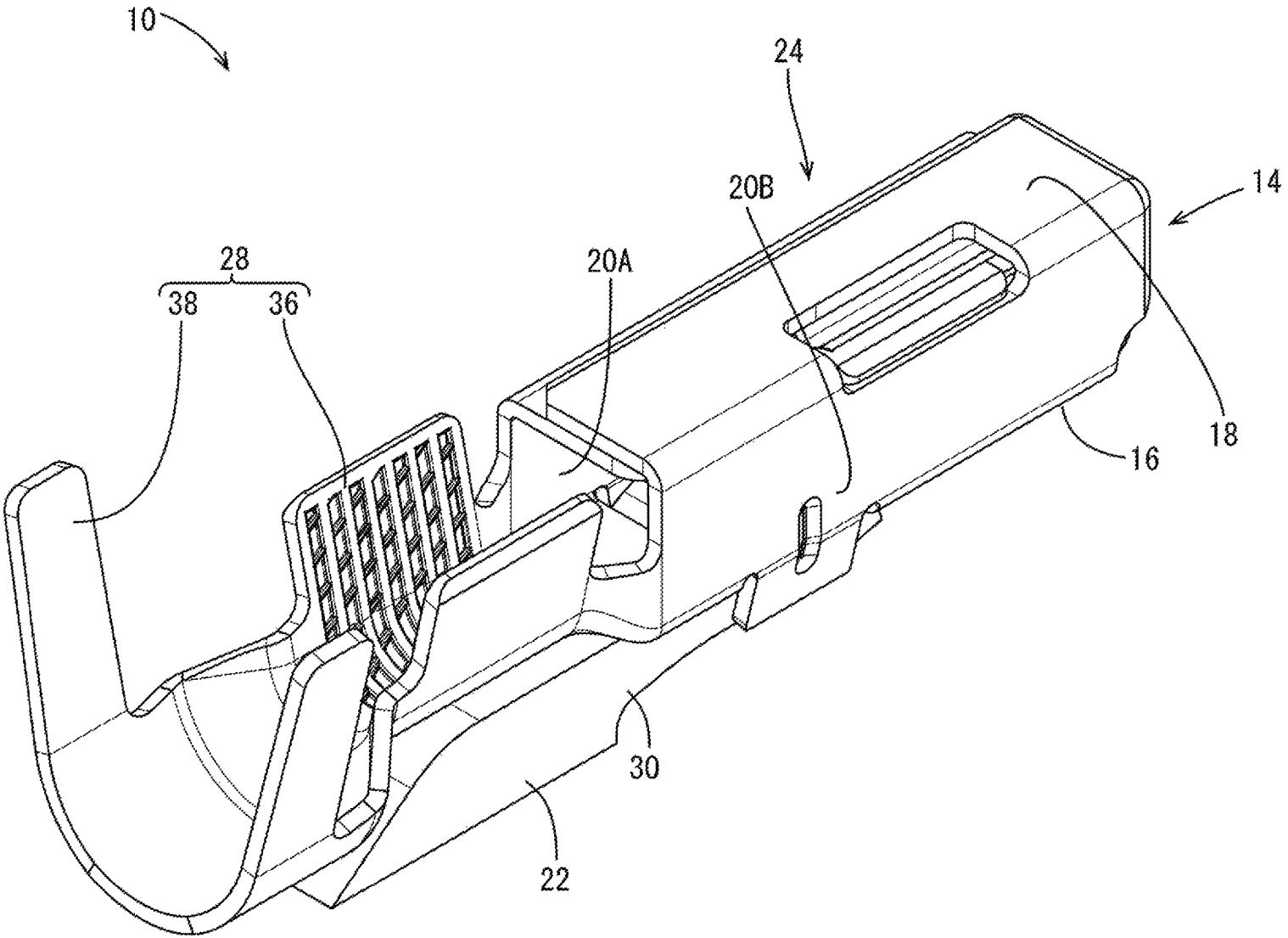
FIG. 2 is a rear perspective view of the female terminal.
Figure 3:
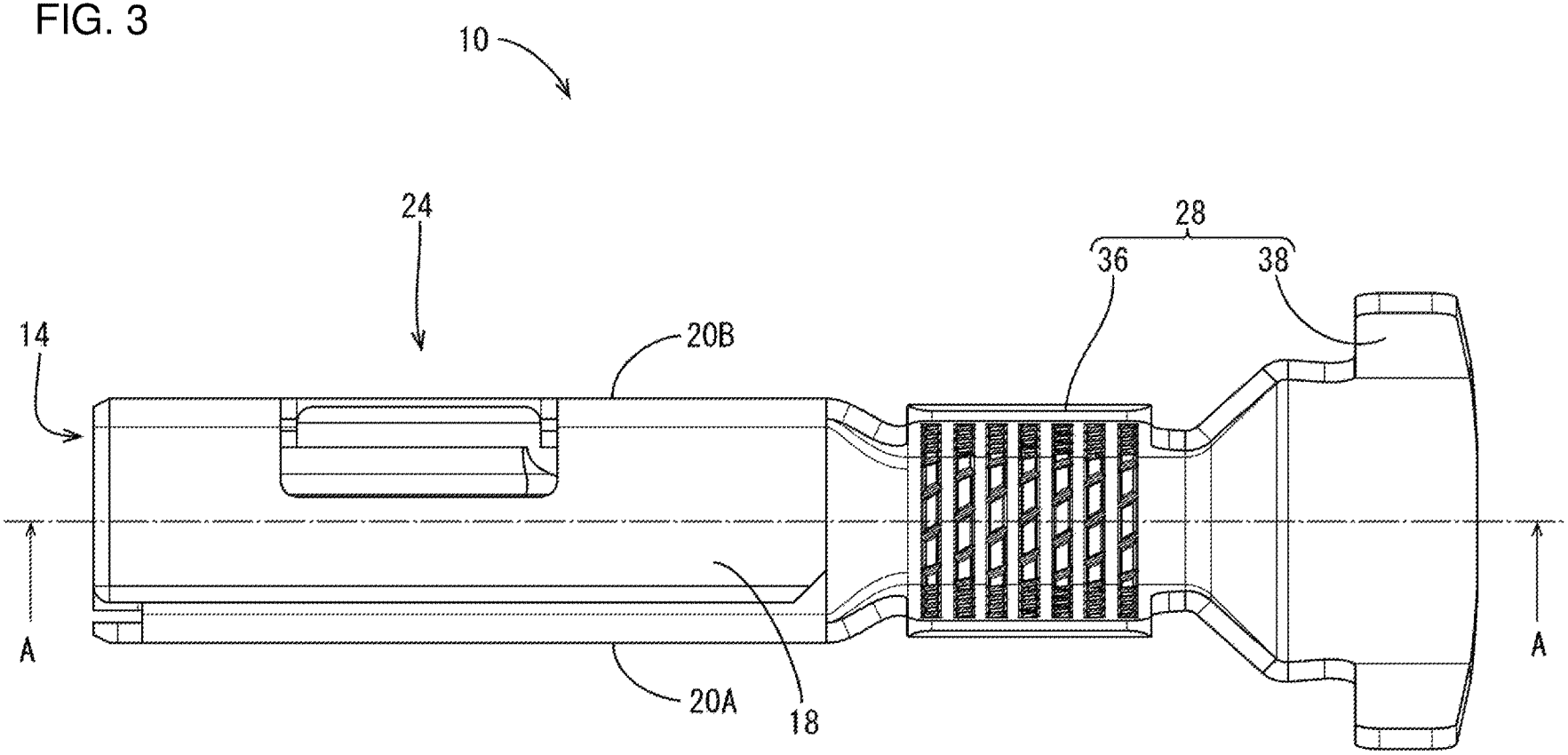
FIG. 3 is a plan view of the female terminal.

As shown in FIGS. 1 and 2, the body 24 includes a ceiling wall 18 located on an upper side, a bottom wall (peripheral wall) 16 located on a lower side and left and right side walls 20A, 20B.

The wire connecting portion 28 projects rearward from the rear end of the bottom wall 16 and includes a wire barrel 36 to be crimped and connected to the core of the unillustrated wire and an insulation barrel 38 to be crimped to a coating of the wire.

As shown in FIG. 4, the resilient piece 26 includes a first resilient piece 26A folded and cantilevered rearward from the bottom wall 16 in the body 24 via a first base end 40 and a second resilient piece 26B folded and cantilevered rearward (same direction as a folding direction of the first resilient piece 26A) from the bottom wall 16 (i.e. peripheral wall connected to the first base end part 40) in the body 24 via a second base end 42. One first resilient piece 26A and one second resilient piece 26B are provided in the body 24.

The first base end part 40 is connected to the front end of the bottom wall 16 and is folded rearward into an arc with the side of the bottom wall 16 as a start end.

The first resilient piece 26A is connected to a final end of the first base end 40 and has an extending portion 44 and a contacting portion 46. The extending portion 44 extends farther away from the bottom wall 16 as the extending portion 44 extends rearward from the first base end part 40. The contacting portion 46 approaches the bottom wall 16 as the contacting portion 46 extends rearward from the rear end of the extending portion 44.

The second base end 42 is behind the first base end 40 (at a position different in the front-rear direction), and is formed by cutting a part of the bottom wall 16 and folding the cut part rearward into an arc with the side of the bottom wall 16 as a start end. The second resilient piece 26B is located closer to the bottom wall 16 than the first resilient piece 26A. The second base end part 42 has substantially the same shape and the same size as the first base end 40, thereby suppressing a stress acting on the first and second base ends 40, 42 being shifted toward either one side when the first and second resilient pieces 26A, 26B are displaced resiliently toward the bottom wall 16.

A rear end P1 of the extending portion 44 of the first resilient piece 26A and a start end P2 of the second base end 42 are provided at the same position in the front-rear direction. When the first resilient piece 26A is displaced resiliently toward the bottom wall 16, the contacting portion 46 of the first resilient piece 26A contacts the second resilient piece 26B.

A bead 48 that is long in the front-rear direction and projects from the ceiling wall 18 toward the bottom wall 16. Further, an insertion hole 50 into which the lock portion 32 of the locking lance 30 of the female housing 22 is inserted is provided to be open in the bottom wall 16. An opening edge of the insertion hole 50 comes into contact with the lock portion 32 of the locking lance 30 from front, whereby the female terminal 10 is retained not to come out rearward. The insertion hole 50 is located behind the second resilient piece 26B.

When the male terminal 12 is inserted into the body 24, the first resilient piece 26A is pressed by the male terminal 12 and resiliently displaced toward the bottom wall 16 with the first base end 40 as a fulcrum, and the second resilient piece 26B is pressed by the contacting portion 46 of the first resilient piece 26A and resiliently displaced toward the bottom wall 16 with the second base end 42 as a fulcrum. Thus, a contact pressure is applied to the male terminal 12 by reaction forces of the first and second resilient pieces 26A, 26B, the male terminal 12 is pressed against the bead 48 of the ceiling wall 18, and the male terminal 12 and the female terminal 10 are connected electrically. At this time, a stress generated due to resilient displacements of the first and second resilient pieces 26A, 26B is distributed to the first and second base ends 40, 42. Thus, a maximum stress applied to the first base end 40 of the first resilient piece 26A is reduced as compared to a configuration with only a first resilient piece, and a reduction of the contact pressure applied to the male terminal 12 due to creep deformation under a high-temperature environment is suppressed.

As described above, according to the first embodiment, when the first resilient piece 26A is displaced resiliently toward the bottom wall (peripheral wall) 16, the second resilient piece 26B is pressed by the first resilient piece 26A and resiliently displaced toward the bottom wall (peripheral wall) 16. Thus, the contact pressure is applied to the male terminal 12 inserted into the body 24 by the reaction forces of the first and second resilient pieces 26A, 26B. At this time, the stress is distributed to the first and second base ends 40, 42 by the resilient displacements of the first and second resilient pieces 26A, 26B. Thus, a maximum stress applied to the base end of one resilient piece is reduced as compared to the configuration in which only one resilient piece is provided, and a reduction of the contact pressure applied to the male terminal 12 due to creep deformation under a high-temperature environment is suppressed.

Further, by setting the rear end position P1 of the extending portion 44 and the start end position P2 of the second base end 42 substantially at the same position in the front-rear direction, the contacting portion 46 of the first resilient piece 26A contacts the second resilient piece 26B and the stress easily is distributed from the contacting portion 46 to the second base end 42.

Further, since the arc of the first base end 40 and that of the second base end 42 have substantially the same size and the same shape, it can be suppressed that the stress applied to the first and second base ends 40, 42 is shifted toward either one side.

A second embodiment is described with reference to FIGS. 5 to 8.

Figure 5:
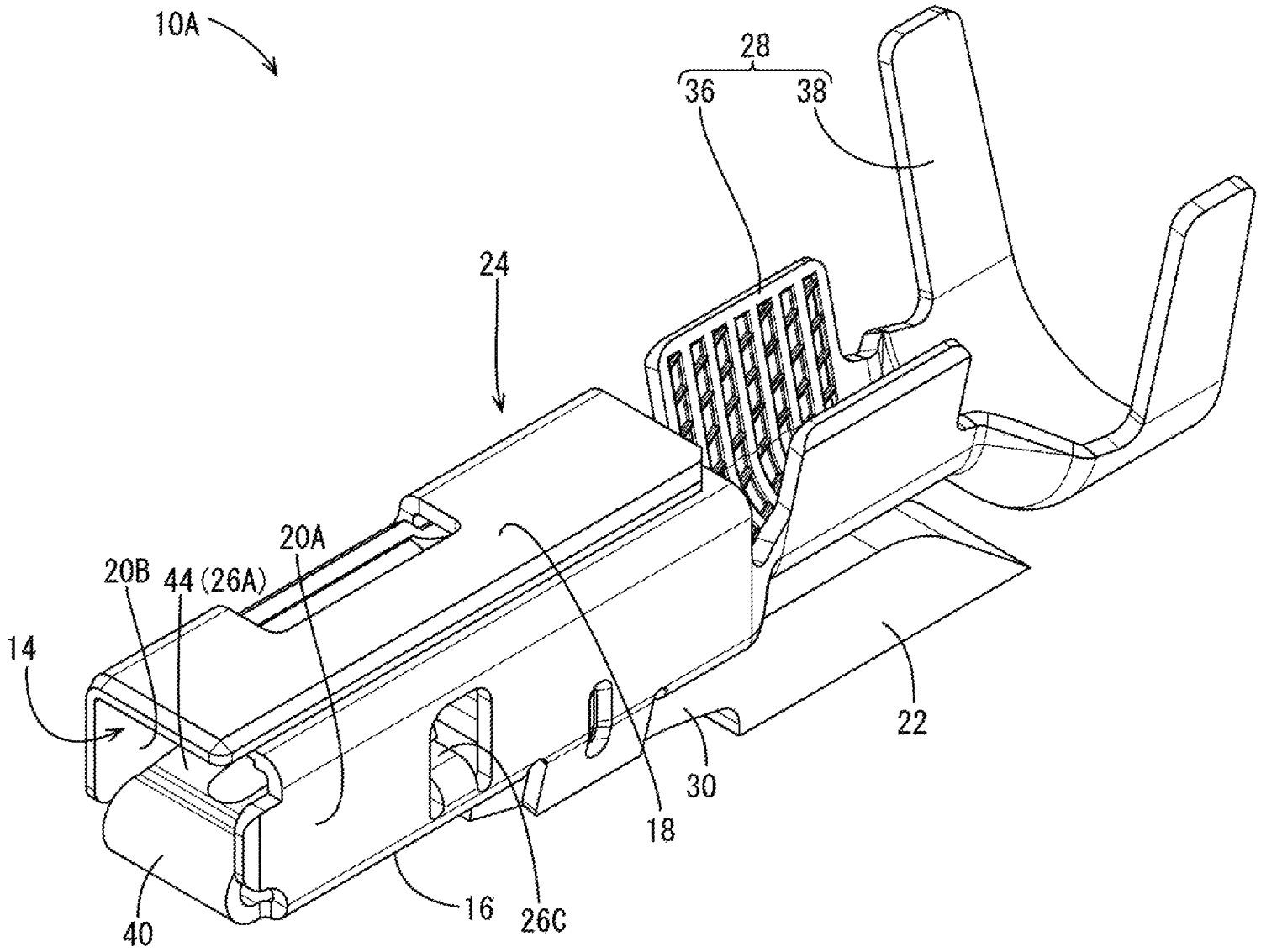
FIG. 5 is a front perspective view of a female terminal in a second embodiment.
Figure 6:
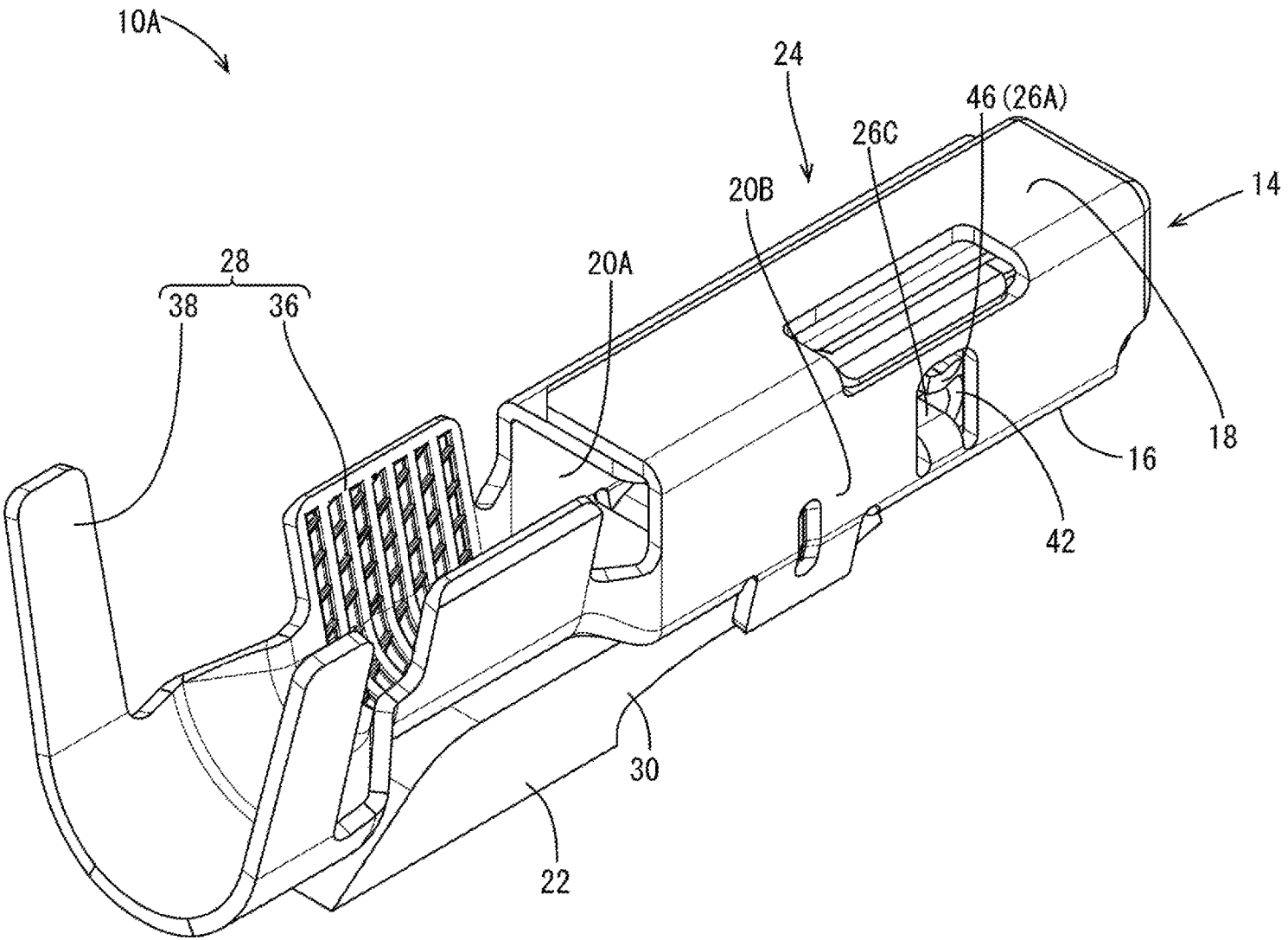
FIG. 6 is a rear perspective view of the female terminal.
Figure 7:
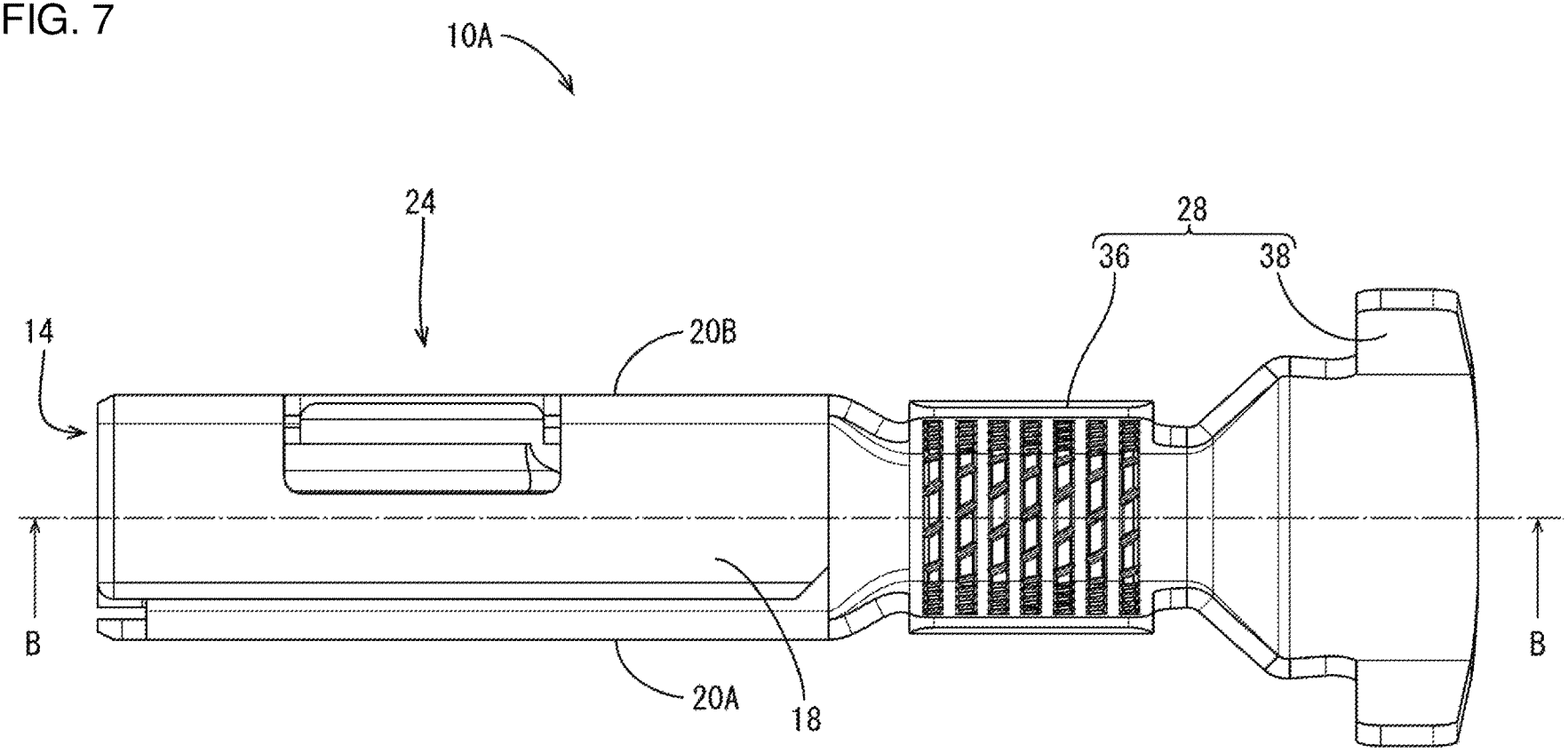
FIG. 7 is a plan view of the female terminal.

As shown in FIGS. 5 and 6, the female terminal 10A of this embodiment differs from the female terminal 10 of the first embodiment in that a pair of auxiliary resilient pieces 26C are provided on side walls 20A, 20B of a body 24.

As shown in FIGS. 5 and 6, the auxiliary resilient pieces 26C are formed by cutting parts of the side walls 20A, 20B and folding the cut parts into the body 24, located closer to a bottom wall 16 than a second resilient piece 26B and resiliently displaceable toward the bottom wall 16.

Figure 8:
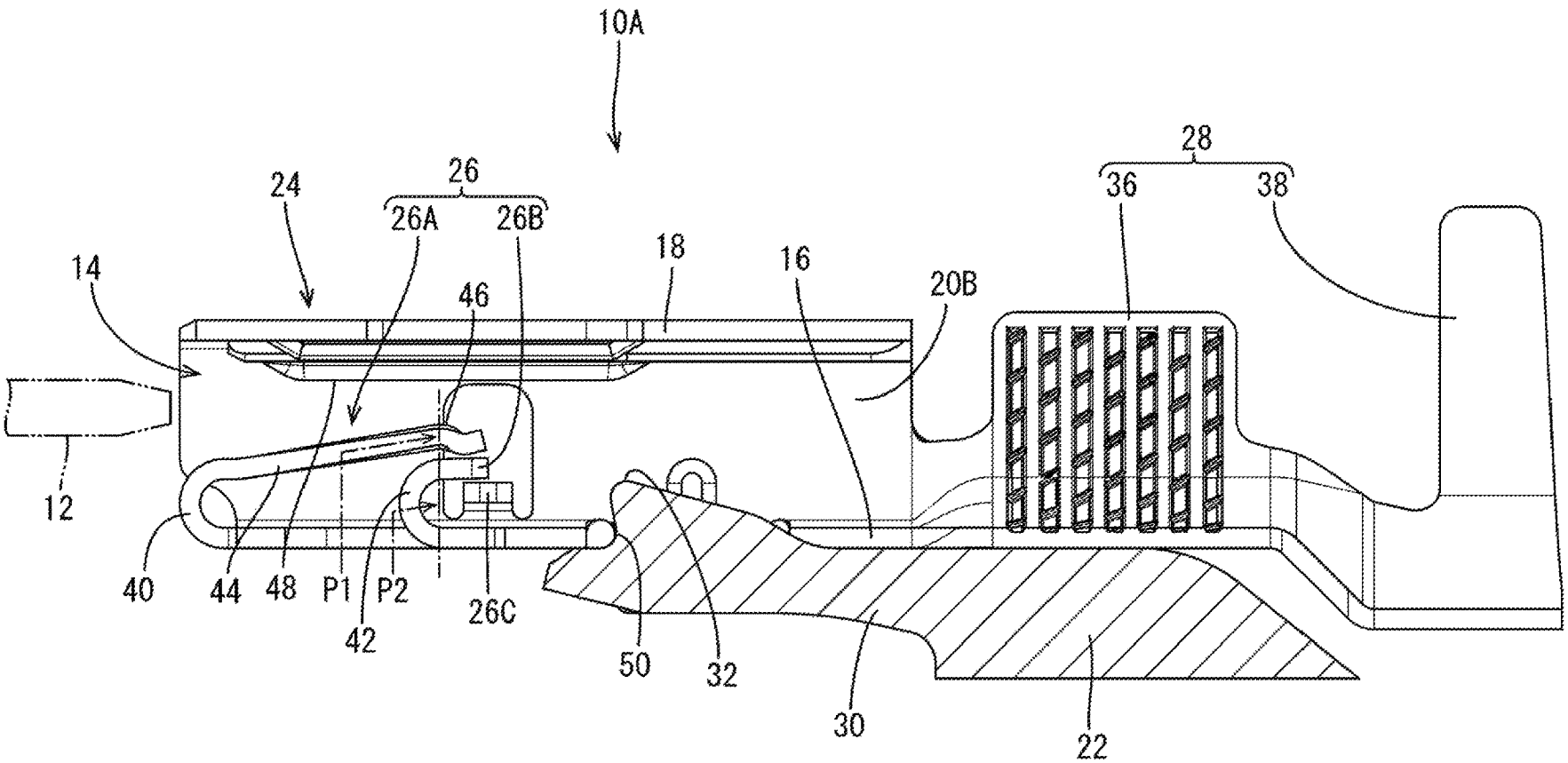
FIG. 8 is a section along B-B in FIG. 7.

As shown in FIG. 8, when a male terminal 12 is inserted into the body 24, a first resilient piece 26A is pressed by the male terminal 12 and resiliently displaced toward the bottom wall 16 with a first base end 40 as a fulcrum, and the second resilient piece 26B is pressed by a contacting portion 46 of the first resilient piece 26A and resiliently displaced toward the bottom wall 16 with a second base end 42 as a fulcrum. Further, the auxiliary resilient pieces 26C are pressed by the second resilient piece 26B and resiliently displaced toward the bottom wall 16. By providing such auxiliary resilient pieces 26C, a stress is distributed to the first base end 40 of the first resilient piece 26A, the second base end 42 of the second resilient piece 26B and the two auxiliary resilient pieces 26C and a reduction of a contact pressure applied to the male terminal 12 due to creep deformation under a high-temperature environment is suppressed more than in the female terminal 10 of the first embodiment. Since the other components are the same as those of the female terminal 10 of the first embodiment, these components are denoted by the same reference signs as in the first embodiment in the drawings (FIGS. 5 to 8) and are not described.

According to the second embodiment, the stress is distributed to the first base end 40 of the first resilient piece 26A, the second base end 42 of the second resilient piece 26B and the auxiliary resilient pieces 26C and creep deformation under a high-temperature environment is suppressed more by providing the auxiliary resilient pieces 26C.

The invention is not limited to the above described and illustrated embodiments. For example, the following various modes also are included.

Although the first and second resilient pieces 26A, 26B are provided on the bottom wall 16, out of the peripheral walls of the body 24, in the first and second embodiments, these resilient pieces may be, for example, provided on the ceiling wall or the side wall(s).

Although the auxiliary resilient pieces 26C are provided on the side walls 20A, 20B in the second embodiment, an auxiliary resilient piece may be provided on one the side wall.

Although one first resilient piece 26A and one second resilient piece 26B are provided in the body 24 in the first and second embodiments, the number of contact points with the male terminal may be increased, for example, by providing one of first resilient pieces and one of second resilient pieces in the lateral direction.

Although the first and second resilient pieces 26A, 26B are folded rearward in the body 24 in the first and second embodiments, these resilient pieces may be folded forward.

LIST OF REFERENCE SIGNS

10, 10A: female terminal
16: bottom wall (peripheral wall)
20A, 20B: side wall
24: body
26A: first resilient piece
26B: second resilient piece
26C: auxiliary resilient piece
40: first base end
42: second base end
44: extending portion
46: contacting portion
P1: rear end position
P2: start end position

What is claimed is:

1. A female terminal, comprising:

a rectangular tubular body extending in a front-rear direction, the body being composed of a bottom wall and at least one side wall extending from the bottom wall;

a first resilient piece having a first base end folded rearward from the bottom wall and projecting into the body, an extending portion cantilevered rearward from the first base end, the extending portion has a rear end and extends farther away from the peripheral wall as the extending portion extends rearward from the first base end to the rear end of the extending portion, and a contacting portion extending from the rear end of the extending portion to approach the peripheral wall as the contacting portion extends rearward from a rear end of the extending portion; and a second resilient piece having a second base end folded rearward into an arc from the bottom wall and cantilevered into the body with the bottom wall as a start end;

wherein:

the first base end and the second base end have identical sizes and shapes the second base end is disposed rearward from the first base end in the front-rear direction;

the second resilient piece is located closer to the bottom wall than the first resilient piece;

the second resilient piece is pressed by the first resilient piece and resiliently displaced toward the bottom wall with the second base end as a fulcrum when the first resilient piece is resiliently displaced toward the bottom wall; and the rear end position of the extending portion of the first resilient piece and a start end position of the second base end are aligned in the front-rear direction an auxiliary resilient piece provided on the at least one side wall and being resiliently displaceable toward the bottom wall;

the auxiliary resilient piece is located closer to the bottom wall than the second resilient piece; and the second resilient piece is pressed by the first resilient piece to resiliently displace the auxiliary resilient piece toward the bottom wall when the first resilient piece is displaced resiliently toward the bottom wall.

2. A female terminal, comprising:

a rectangular tubular body extending in a front-rear direction, the body being composed of a plurality of peripheral walls;

the plurality of peripheral walls including a bottom wall and at least one side wall extending from the bottom wall, a first resilient piece folded and cantilevered from the bottom wall into the body via a first base end; and a second resilient piece cantilevered from the bottom wall and folded into the body via a second base end in the same direction as a folding direction of the first resilient piece, wherein:

the second base end is disposed at a position different from the first base end in the front-rear direction;

the second resilient piece is located closer to the bottom wall than the first resilient piece;

the second resilient piece is pressed by the first resilient piece and resiliently displaced toward the bottom wall with the second base end as a fulcrum when the first resilient piece is resiliently displaced toward the bottom wall;

an auxiliary resilient piece provided on the at least one side wall resiliently displaceable toward the bottom wall;

the auxiliary resilient piece is located closer to the bottom wall than the second resilient piece; and the second resilient piece is pressed by the first resilient piece to resiliently displace the auxiliary resilient piece toward the bottom wall when the first resilient piece is displaced resiliently toward the bottom wall.

3. The female terminal of claim 2, wherein the first base end and the second base end have identical sizes and shapes.

* * * * *